United States Patent [19]

Mellerowicz

[11] 4,317,848

[45] Mar. 2, 1982

[54] METHOD OF SEWAGELESS METALLIZATION, ESPECIALLY GALVANIZING OF A STEEL SURFACE

[75] Inventor: Ryszard Mellerowicz, Poznań, Poland

[73] Assignee: Kombinat Produkcji i Montazu Obiektow Budownictwa Ogolnego z Lekkich Konstrukcji Stalowych "Metalplast", Obnorniki, Poland

[21] Appl. No.: 141,196

[22] Filed: Apr. 17, 1980

[30] Foreign Application Priority Data

Apr. 26, 1979 [PL] Poland ..... 215171

[51] Int. Cl.[3] ..... C23C 1/02

[52] U.S. Cl. ..... 427/309; 427/310; 427/328; 427/329; 427/345; 148/6.15 R; 148/6.2

[58] Field of Search ..... 148/6.15 R, 6.15 Z; 427/345, 310, 309, 328, 329

[56] References Cited

U.S. PATENT DOCUMENTS

| | | | |
|---|---|---|---|
| 2,992,146 | 7/1961 | Low | 148/6.15 R |
| 3,906,895 | 9/1975 | Morino | 148/6.14 R |
| 4,130,446 | 12/1978 | Murakami | 427/345 |

*Primary Examiner*—Ralph S. Kendall

[57] ABSTRACT

A method is described for metalizing, particularly zinc-coating of steel surfaces in such manner that the production of sewage and/or harmful waste products is substantially eliminated. The various steps employed include degreasing, etching, activation, and metallization of the metal substrate by successive immersion of the substrate in baths containing, respectively, the necessary components to perform the function of each bath and also the components of the preceding bath, recycling the wash products from each bath to a preceding bath containing the same components as said waste products, and rinsing the product with water only after completion of the successive method steps.

1 Claim, 8 Drawing Figures

METHOD OF SEWAGELESS METALLIZATION, ESPECIALLY GALVANIZING OF A STEEL SURFACE

Figure 1:
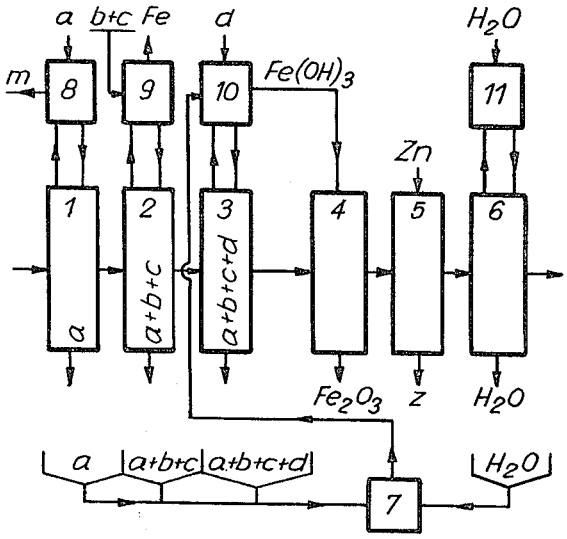

An application of the invention renders it possible to eliminate an emission of sewage into the natural environment, bringing at the same time savings of raw materials, water and energy.

The invention can be applied especially in applying of zinc coatings, however, it can be also used for applying of other metals.

The subject of the invention is a method of sewageless metallization, especially galvanizing of a steel surface.

The known methods of sewageless metallization of a metal surface are carried out in gaseous oxidizing and reducing atmospheres and are of a limited application because they are suitable for continuous metallization of strips, sheet metal and wires. In metallization of objects of differentiated shapes the surface treatment of the surface to be metallized consists in dipping it in various baths in order to remove impurities such as: grease, rust, scale. To remove greases a steel surface is usually dipped in a bath containing alkaline compounds and surface-active substances. After use these baths can be regenerated by means of a known method. Metal surfaces can be also degreased in organic solvents, in vapours of a solvent, in emulsions, etc. However, these methods may be applied only in small metallization objects because of intense evaporation of solvents. Usually to remove rust and scales etching in a mineral acid is applied, especially in hydrochloric acid and sulphuric acid which can be also regenerated after use. Sometimes, pickling and activation of the metal surface is additionally applied, especially dipping in a flux at metallization by a hot method.

Metal coatings are applied by various methods: a hot method consisting in dipping in a liquid metal, a galvanic method, a diffusion method or a metal spraying method.

The applied metal coatings are subjected to finishing which consists in washing in water, washing agents, chromate or phosphate baths.

In the process of purification of surfaces before metallization as well as in metallization by the galvanic method sewage is produced. The used baths in large metallization objects are regenerated so that they circlate in a closed cycle. Nevertheless, sewage is produced which results from dripping of the bath away from the surface being treated between particular operations of the surface treatment, from leakages, damages, and especially from the washing process between particular operations. Interoperation washing is applied in order to reduce a transfer of bath components into the succeeding bath as well as undesirable impurities such as greases, iron, heavy metals.

On a surface brought upward from a bath considerable amounts of a liquid are raised which, depending on the density and the viscosity of the bath as well as on the shape of the surface, vary from 30 up to 500 ml/m$^2$. To reduce the consumption of water and the amount of sewage from washing a repeated cascade washing is more and more frequently applied nowadays, however, this results in a prolongation of the surface treatment process and an increase of the cost of apparata.

There are also known methods for utilization of sewage, which make use of evaporation of water, processing in an ion exchanger, ultrafiltration, diaphragm electrolysis, however, all these methods require an application of a complicated equipment or large power inputs, which results in that these methods—despite the fact that they enable obtaining of closed water cycles—have not yet found a wide application in the industrial practice.

The problem of sewage from the metallization process is also not solved in general by methods of washing in intermediate solutions, for instance, washing in chlorides in Lancy's method or activation in cyanides at metallization in cyanide baths. In industrial practice there still dominate traditional methods of metallization and purification of sewage by neutralization with alkaline compounds. Sewage from the metallization process is difficult to purify because it is a mixture of various chemical compounds. For the utilization of this sewage a separate complicated installation is necessary. Since requirements concerning cleanness of waters are being continuously sharpened, even at an efficiently operating sewage-treatment plant, it is rarely possible to obtain a satisfactory cleanness of sewage and therefore the metallization process is associated with an emission of harmful substances into the natural environment.

The object of the invention is to work out such a sewageless method of metallization of a metal surface of any shape so that an emission of sewage into the natural environment is completely eliminated at a minimum power, material and apparata expenditures.

The method of sewageless metallization comprising operations of purification of a metal surface, especially in a degreasing bath, a pickling solution, an activating bath or a flux bath, an operation of applying a metal coating, especially by a method of dipping in a liquid metal, a galvanic method or a diffusion method, finishing operations, especially washing, drying or chromating or phosphatizing together with processes of regeneration of the used baths, consists in that a steel surface is dipped in succession in baths containing a higher and higher or the same number of components as the preceding bath, and between particular operations of the surface treatment there is applied at most a washing in a purified bath returning from the regeneration process or from a used bath designed for regeneration in a thinned bath, whereby drippings from the whole process or drippings collected separately from certain operations are used again by adding them to a bath containing the same number of components as the added drippings, and then the used bath is regenerated by a known method. In the presented method in the succeeding baths the number of components increases or remains the same, whereas the concentration of determined components in the succeeding baths may be—depending on the requirements—lower, higher or the same as in the preceding bath. The hitherto undesirable phenomenon of the bath being raised on the processed surface, which is counteracted by an application of washing in water, is utilized for transferring of necessary components to the succeeding bath wherein they are utilized again. Undesirable impurities of a bath which get into it during the process of cleaning the surface, such as greases, iron and other metals, are not considered to be components of the bath. Since each succeeding bath is made from the preceding bath, washing in water is not necessary, and even any washing process is not necessary. At most, if products are strongly greased and corroded or if an excessive circulation of the bath through the installation to regeneration is undesirable, then washing in a fresh or a used bath may be applied, or even cascade washing in a bath circulating in a closed cycle may be applied. If it is advisable to reduce the concentration of any component in succeeding baths, then washing in an appropriately diluted bath is applied.

The elimination of the interoperation process of washing in water causes that drippings, leakages and damage sewage—which are jointly called drippings for the purpose of simplification—are strongly concentrated. Collected together, they correspond to the final bath as far as the number of components and the concentration are concerned, therefore they may be added to it and utilized again. It is also possible, especially in big objects, to collect separately drippings from different processes and to add them to an appropriate bath containing an identical number of components. Evaporation of water from the surface of a bath results in that baths concentrate spontaneously. Losses of water in baths can be made up with fresh water or with water obtained from washing of products after metallization.

In a metallization process carried out by the galvanic method the bath for finishing, e.g. the bath for chromating, can be made from the preceding bath, whereas in the hot method the process of an increase of the number of components in succeeding baths is completed in the flux bath.

The practical application of the invention is relatively simple. Appropriate concentrations of components in particular baths establish spontaneously, depending on the size and the geometrical shape of the surface being metallized and on the initial parameters of the bath. Repeated utilization of components in different baths enables reducing of the consumption of materials. The elimination of the process of washing in water renders it possible to reduce considerably the consumption of water and to reduce the length of the production line. So, applicating of the invention renders it possible to eliminate completely an emission of sewage into the natural environment and at the same time to achieve considerable savings of raw materials, water, energy and labour. Waste materials, usually solid, which are produced in the process of regeneration of used baths, can be utilized as raw materials in other industrial processes.

A substantial technological arrangement of an installation for metallization depends on many factors, and especially on the degree of greasiness and corrosion of the surface, the degree of development and the geometrical shape of the surface, the volume of production, requirements concerning the type and the quality of the applied metal coating, as well as the type of the base to be metallized. The method according to the invention which can be applied in various variants is explained in eight examples of its embodiment, which are illustrated by technological diagrams, wherein Example 1 presents hot galvanizing of objects made of cold-rolled steel, Example 2 presents hot galvanizing of strongly corroded and greased objects, Example 3 presents galvanizing of small bolts in faucets, with an application of an aminochloride bath, Example 4 presents galvanizing of a steel strip together with chromating, Example 5 presents the galvanizing process, Example 6 presents the process of hot aluminizing, Example 7 presents the process of currentless nickel plating of steel objects, and Example 8 presents the process of nickel plating of objects made of copper or copper-plated.

The figures of the drawings show schematically embodiments of the invention corresponding to the examples.

EXAMPLE 1

Steel products at an amount of 20,000,000 kg annually, whereof the total area of 2,500,000 $m^2$ is covered with scales of a quantity of 15 $g/m^2$, are subjected to hot galvanizing. Steel objects are in succession dipped in a degreasing bath 1, a pickling bath 2, a flux bath 3, then are dried 4, dipped in liquid zinc 5, and cooled in water 6.

The chemical compositions of particular baths and drippings are presented in a table below herein, and the circulation of baths and drippings is presented in a technological diagram FIG. 1 wherein for the purpose of simplification a wetting agent being an equilibrium mixture of ethoxylated alkylphenol—whose trade name is roccaphenol N-8—with sodium phosphate is designated with the symbol a, hydrochloric acid is designated with the symbol b, an inhibitor—hexamethylenetetramine—with c, a flux being a mixture of zinc chloride, calcium chloride, sodium chloride—of a composition specified in the table—with the symbol d.

The used degreasing bath is purified by a known method from slimes and greases 8, hydrochloric acid is regenerated by means of diaphragm electrolysis 9, whereas the used flux is continuously purified from iron 10 and the separated ferric hydroxide is dried in a dryer 4. Between particular operations washing in water is not applied, therefore drippings are a concentrated bath containing all the components appearing in the flux 7. Said drippings are added to the used flux. Losses of water resulting from evaporation of the bath are made up with water from cooling of products after galvanizing 8. The process of coating a steel surface with other metals may proceed quite similarly, especially the process of hot galvanizing and leading.

| | | Content of a component in an aqueous solution in % | | | | | | | | |
|---|---|---|---|---|---|---|---|---|---|---|
| Item | Process | a | b | c | Cl | Fe | Zn | Ca | Na | $NH_3$ |
| 1. | Degreasing | 1 | | | | | | | | |
| 2. | Pickling | 0.3 | 14.5 | 0.15 | 21.2 | 5.5 | | | | |
| 3. | Fluxing | 0.2 | 0.3 | 0.15 | 21.9 | 0.3 | 9.2 | 2.2 | 1.2 | 1.3 |
| 4. | Drying | | | | | | | | | |
| 5. | Hot galvanizing | | | | | | | | | |
| 6. | Cooling | 0.3 | 4.2 | 0.15 | 18.1 | 2.3 | 10.5 | 1.1 | 1.0 | 0.6 |
| 7. | Storing of drippings | | | | | | | | | |

LIST OF DESIGNATIONS IN FIG. 1

1—degreasing
2—pickling
3—fluxing
4—drying
5—hot galvanizing 6—cooling
7—storing of drippings
8—regeneration of a degreasing bath
9—regeneration of hydrochloric acid
10—regeneration of a flux
11—water cooler
a—wetting agent
b—hydrochloric acid
c—inhibitor
d—flux
m—precipitate
z—zinc wastes.

EXAMPLE 2

Figure 2:
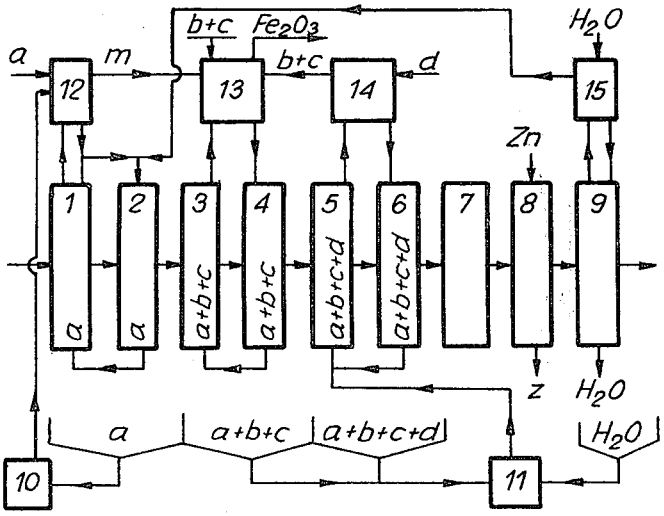

Steel structures amounting to 100,000,000 kg annually, whereof a total area of 9,000,000 $m^2$ is covered with scales of a quantity of 70 $g/m^2$, is subjected to hot galvanizing. Steel structures are degreased 1, washed in a diluted degreasing bath 2 in order to reduce the concentration of a wetting agent in hydrochloric acid, pickled in hydrochloric acid 3, washed in fresh hydrochloric acid returning from regeneration and serving at the same time for pickling 4, washed in a flux 5, dipped in a flux 6, dried 7, dipped in liquid zinc 8 and cooled in water 9. Faulty zinc coatings are pickled in a used flux 5. Chemical compositions of particular baths and drippings are presented in the table and the circulation of baths and drippings is shown in a technological diagram FIG. 2 wherein for the purpose of simplification the wetting agent—which is an equilibrium mixture of ethoxylated alkylphenol/whose trade name is roccaphenol N-8/with a mixture of phosphoric mono- and diesters of aliphatic alcohol neutralized by diethanolamine, whose trade name is rokanol PL-4—is designated with the symbol a, hydrochloric acid—with the symbol b, an inhibitor being an equilibrium mixture of hexamethylenetetramine with diphenylamine—c, a flux being a mixture of zinc chloride, ammonium and stannic chlorides of the composition specified in the table—d.

The used degreasing bath is purified by a known method from slimes and greases 12 which are then burnt in a known process of regeneration of hydrochloric acid 13 consisting in thermal destruction of ferrous chloride into hydrogen chloride and ferric oxide. Hydrochloric acid and ferric chloride separated from the used flux by means of extraction 14 are also turned back to the regeneration process. Drippings from the degreasing process are collected separately 10 and added to the used degreasing bath in the process of regeneration of the degreasing bath. The remaining drippings 11 are added to the used flux.

| | | Content of a component in an aqueous solution in % | | | | | | | |
|---|---|---|---|---|---|---|---|---|---|
| Item | Process | a | b | c | Cl | Fe | Zn | $NH_3$ | Sn |
| 1. | Degreasing | 5 | | | | | | | |
| 2. | Washing | 1.5 | | | | | | | |
| 3. | Pickling | 0.5 | 10.4 | 0.02 | 19.7 | 7.3 | | | |
| 4. | Washing | 0.2 | 16.5 | 0.02 | 19.7 | 2.5 | | | |
| 5. | Washing and dezincification | 0.2 | 2.9 | 0.02 | 20.1 | 0.8 | 10.2 | 3.3 | 0.15 |
| 6. | Fluxing | 0.2 | 0.8 | 0.02 | 20.3 | 0.2 | 9.8 | 3.3 | 0.15 |
| 7. | Drying | | | | | | | | |
| 8. | Hot galvanizing | | | | | | | | |

-continued

| | | Content of a component in an aqueous solution in % | | | | | | | |
|---|---|---|---|---|---|---|---|---|---|
| Item | Process | a | b | c | Cl | Fe | Zn | $NH_3$ | Sn |
| 9. | Cooling | | | | | | | | |
| 10. | Drippings from degreasing | 3.1 | | | | | | | |
| 11. | Remaining drippings | 1.4 | 4.5 | 0.02 | 13.2 | 2.8 | 4.1 | 1.2 | 0.05 |

Onto a part of products zinc-plated by the method according to the invention a conversion phosphate coating is applied by a known method, and then a paint coating. The process of hot galvanizing may be also much similar thereto.

LIST OF DESIGNATIONS IN FIG. 2

1—degreasing
2—washing after degreasing
3—pickling
4—washing and additional pickling
5—washing and dezincification
6—fluxing
7—drying
8—hot galvanizing
9—cooling
10—a tank for drippings from degreasing
11—a tank for acid drippings
12—regeneration of the degreasing bath
13—regeneration of hydrochloric acid
14—regeneration of the flux
15—water cooler
a—wetting agent
b—hydrochloric acid
c—inhibitor
d—flux
m—precipitate
z—zinc wastes.

EXAMPLE 3

Small steel bolts amounting to 100,000 kg annually are galvanized in plating barrels. Steel bolts are initially degreased in vapours of trichloroethylene which are then separated from greases by distillation, then the bolts are degreased 1, washed 2, pickled in hydrochloric acid 3, washed in the used bath for galvanizing 4, washed again 5, galvanized in an aminochloride bath 6, washed three times in water 7, 8, 9, and dried 10.

Figure 3:
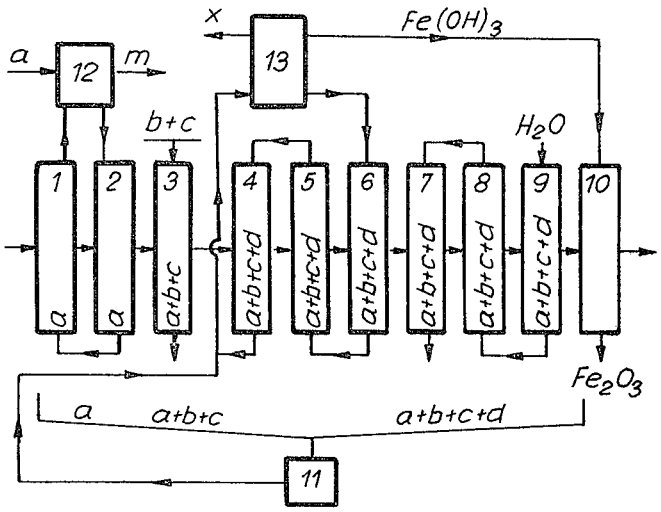

Chemical compositions of particular baths and drippings is presented in the table, and the circulation of baths and drippings—in the technological diagram FIG. 3 wherein for the purpose of simplification the degreasing bath being an equilibrium mixture of sodium hydroxide and phosphate is designated by the symbol a, hydrochloric acid—b, an inhibitor—triethanolamine—c, an electrolyte being a mixture of zinc and ammonium chlorides—d. Drippings from all processes 11 are added to the used bath for galvanizing. The used degreasing bath is purified by a known method from slimes and greases 12. The contaminated bath for galvanizing is purified by a known method from iron 13 by a separation of ferric hydroxide which is then dried 10. An excess of the purified aminochloride bath is supplied to an electrochemical plant producing Leclanche's cells.

| item | Process | Content of a component in an aqueous solution in % | | | | | | |
|---|---|---|---|---|---|---|---|---|
| | | a | b | c | Cl | Fe | Zn | $NH_3$ |
| 1. | Degreasing | 1 | | | | | | |
| 2. | Washing | 1 | | | | | | |
| 3. | Pickling | 0.3 | 15.4 | 0.01 | 20.8 | 4.2 | | |
| 4. | Washing and de-zincification | 0.3 | 2.7 | 0.01 | 18.8 | 0.8 | 4.5 | 4.2 |
| 5. | Washing | 0.3 | 0.4 | 0.01 | 18.5 | 0.1 | 4.7 | 4.3 |
| 6. | Galvanizing | 0.3 | 0.01 | 0.01 | 18.1 | 0.02 | 4.8 | 4.4 |
| 7. | Washing I | 0.15 | 0.005 | 0.005 | 9.1 | 0.01 | 2.4 | 2.2 |
| 8. | Washing II | 0.05 | 0.002 | 0.002 | 3.2 | 0.04 | 0.8 | 0.7 |
| 9. | Washing III | 0.01 | 0.0004 | 0.0004 | 0.6 | 0.008 | 0.16 | 0.1 |
| 10. | Drying | | | | | | | |
| 11. | Storing of sewage | 0.2 | 3.2 | 0.005 | 9.4 | 1.5 | 2.1 | 1.9 |

The process of galvanizing, cadmium plating, nickel plating by means of chloride baths may proceed quite similarly.

LIST OF DESIGNATIONS IN FIG. 3

Figure 4:
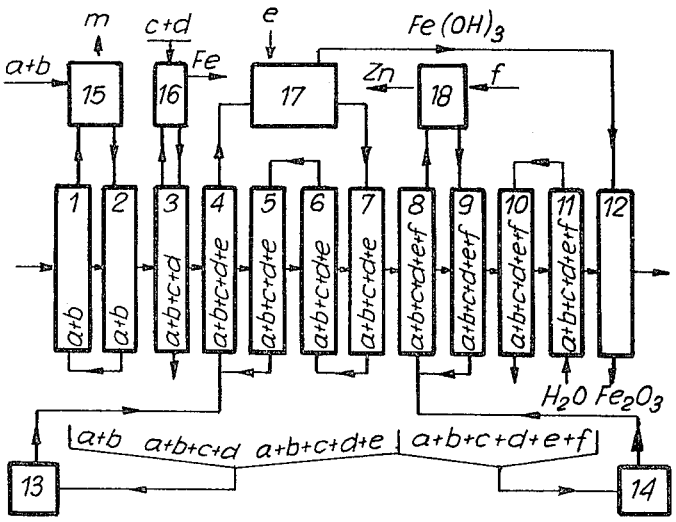

1—degreasing
2—washing after degreasing
3—pickling
4—washing I in an aminochloride bath
5—washing II in an aminochloride bath
6—galvanizing in an aminochloride bath
7—washing I after galvanizing
8—washing II after galvanizing
9—washing III after galvanizing
10—drying
11—a tank for drippings
12—regeneration of the degreasing bath
13—regeneration of the aminochloride bath
a—wetting agent
b—hydrochloric acid
c—inhibitor
d/—aminochloride bath
m—precipitate coating is dipped in a fres chromate bath 9, washed twice in water 10, 11, and dried 12. Chemical compositions of particular baths are presented in the table, and the circulation of baths and drippings—in a technological diagram FIG. 4 wherein for the purpose of simplification the wetting agent which is ethoxylated alkylphenol having the trade name rokafenol N-8 is designated by the symbol a, sodium hydroxide—b, sulphuric acid—c, skin glue—d, chromium dehydrate—f. The used degreasing bath is purified by a known method from slimes and greases 15. The used sulphuric acid is by a known method subjected to electrolytic regeneration 16, and a contaminated bath for galvanizing is purified from iron 17 by a separation of a precipitate of ferric hydroxide which is then dried 12. The contaminated bath for chromating is regenerated by electrolysis 18 during which zinc evolves on the cathode and chromium oxidizes on the anode. Chromium drippings from the process of passivation and washing after chromating are collected separately 14 and turned back to the process of regeneration of the chromate bath 18. The produced drippings are collected 13 and added to the used bath for galvanizing.

| item | Process | Content of a component in an aqueous solution in % | | | | | | | |
|---|---|---|---|---|---|---|---|---|---|
| | | a | b | c | d | $SO_4^{-2}$ | Fe | Zn | f |
| 1. | Degreasing I | 0.5 | 5 | | | | | | |
| 2. | Degreasing II | 0.5 | 5 | | | | | | |
| 3. | Pickling | 0.2 | 2 | 12.2 | 0.1 | 22.8 | 6.1 | 1 | |
| 4. | Washing | 0.2 | 2 | 3.9 | 0.1 | 23.0 | 1.8 | 12.5 | |
| 5. | Washing II | 0.2 | 2 | 1.8 | 0.1 | 23.1 | 1.6 | 12.3 | |
| 6. | Washing III | 0.2 | 2 | 0.4 | 0.1 | 23.1 | 0.2 | 12.1 | |
| 7. | Galvanizing | 0.2 | 2 | 0.1 | 0.1 | 22.9 | 0.05 | 12.3 | |
| 8. | Washing | 0.08 | 1.5 | 2 | 0.04 | 18.9 | 0.008 | 2.3 | 8.2 |
| 9. | Chromating | 0.1 | 2 | 3 | 0.05 | 23.0 | 0.01 | 0.5 | 10.5 |
| 10. | Washing I | 0.01 | 0.2 | 0.3 | 0.05 | 2.3 | 0.001 | 0.05 | 1.1 |
| 11. | Washing II | 0.001 | 0.002 | 0.03 | 0.005 | 0.23 | 0.0001 | 0.005 | 0.1 |
| 12. | Drying | | | | | | | | |
| 13. | Zinc drippings | 0.3 | 3 | 3.7 | 0.08 | 21.8 | 1.9 | 8.2 | |
| 14. | Chromium drippings | 0.02 | 0.4 | 0.6 | 0.01 | 4.6 | 0.002 | 0.1 | 2 |

z—a solution of zinc and ammonium chlorides for production of an electrolyte for Leclanche's cells.

EXAMPLE 4

Steel strip amounting to 200,000,000 kg anually is galvanized, and then zinc coatings are subjected to finishing consisting in chromating. The strip is degreased 1, degreased again 2, pickled in hydrochloric acid 3, washed three times in the used bath after galvanizing 4, 5 and 6, and galvanized in a sulfate bath 7, then washed in a used bath for chromating 8, then the zinc The process of tinning, cadmium plating by means of sulfate baths may proceed quite similarly.

LIST OF DESIGNATIONS IN FIG. 4

1—degreasing I
2—degreasing II
3—pickling
4—washing I in a sulfate bath
5—washing II in a sulfate bath
6—washing III in a sulfate bath
7—galvanizing in a sulfate bath 8—washing in a chromate bath
9—chromating
10—washing I after chromating
11—washing II after chromating
12—drying
13—a tank for zin drippings
14—a tank for chromium drippings
15—regeneration of the degreasing bath
16—regeneration of the pickling solution
17—regeneration of the sulfate bath
18—regeneration of the chromate bath
a—wetting agent
b—sodium hydroxide
c—sulphuric acid
d/—inhibitor
e—sulfate bath
f—chromium dehydrate
m—precipitate.

EXAMPLE 5

Small steel objects amounting to 500,000 kg are degreased in vapours of trichloroethylene regenerated by distillation. The products initially degreased are degreased again electrolytically in an alkaline bath 1, washed 2 in order to reduce the concentration of alkalies in the succeeding processes, pickled in an acid 3, washed twide in the used sulfate bath 4 and 5, galvanized in a sulphate bath 6, washed four times in water 7, 8, 9 and 10, dried 11.

Figure 5:
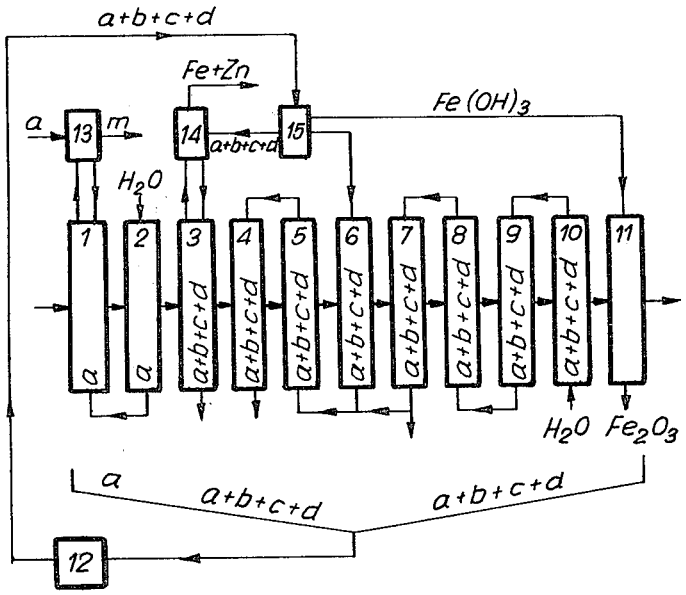

Chemical compositions of particular baths is presented in the table, and the circulation of baths and drippings—in a technological diagram FIG. 5 wherein the degreasing bath is a mixture of sodium hydroxide, sodium phosphate and ethoxylated alkylphenol whose trade name is rokafenol N-8, said compounds being mixet at the ratio 2:2:1, the pickling solution which is designated by the symbol b is a mixture of sulphuric and phosphoric acids mixed at the ratio 10:1, the inhibitor designated by the symbol c is a triethanolamine, and the electrolyte d is a mixture of sulfates and phosphates of zinc, sodium and aluminium with a small addition of 0.1% sugar and 0.1% salicylaldehyde, the mass ratio of zinc, sodium and aluminium being 20:2:1.

The used degreasing bath is purified by a known method from slimes and greases 13. Used acid is subjected to electrolyte regeneration 14, and the contaminated bath is purified from iron 15 by precipitation of ferric hydroxide which is then dried. Drippings are collected 12 and added to the used bath for galvanizing. An excess of the bath for galvanizing, which contains mainly zinc sulfate, is subjected to an electrolysis, and recovered sulphuric acid is turned back to the pickling process.

| | | Content of a component in an aqueous solution in % | | | | | |
|---|---|---|---|---|---|---|---|
| item | Process | a | b | c | d | Fe | Zn |
| 1. | Degreasing | 3.2 | | | | | |
| 2. | Washing | 1.9 | | | | | |
| 3. | Pickling | 1.1. | 12.1 | 0.1 | 2.5 | 3.7 | 0.6 |
| 4. | Washing I | 1.1 | 1.2 | 0.1 | 24.6 | 0.8 | 5.9 |
| 5. | Washing II | 1.1 | 0.9 | 0.1 | 28.3 | 0.2 | 6.7 |
| 6. | Galvanizing | 1.1 | 0.4 | 0.1 | 28.9 | 0.05 | 6.9 |
| 7. | Washing I | 0.5 | 0.2 | 0.05 | 13.8 | 0.02 | 3.3 |
| 8. | Washing II | 0.2 | 0.08 | 0.02 | 5.5 | 0.01 | 1.2 |
| 9. | Washing III | 0.1 | 0.03 | 0.01 | 2.2 | 0.05 | 0.5 |
| 10. | Washing IV | 0.04 | 0.01 | 0.004 | 0.8 | 0.02 | 0.2 |
| 11. | Drying | — | — | — | — | — | — |

-continued

| | | Content of a component in an aqueous solution in % | | | | | |
|---|---|---|---|---|---|---|---|
| item | Process | a | b | c | d | Fe | Zn |
| 12. | Drippings | 0.9 | 2.1 | 0.05 | 11.1 | 0.7 | 2.6 |

After cleaning the objects are dip-painted. The process of cadmium plating, tinning, nickel plating and coppering may proceed in a similar manner.

LIST OF DESIGNATIONS IN FIG. 5

1—degreasing
2—washing after degreasing
3—pickling
4—washing I after pickling
5—washing II after pickling
6—galvanizing in a sulfate bath
7—washing I after galvanizing
8—washing II after galvanizing
9—washing III after galvanizing
10—washing IV after galvanizing
11—drying
12—drippings
13—regeneration of the degreasing bath
14—regeneration of sulphuric acid
15—regeneration of the sulfate bath
a—degreasing bath
b—sulphuric and phosphoric acids
c—inhibitor
d—bath for galvanizing
m—precipitate.

EXAMPLE 6

Figure 6:
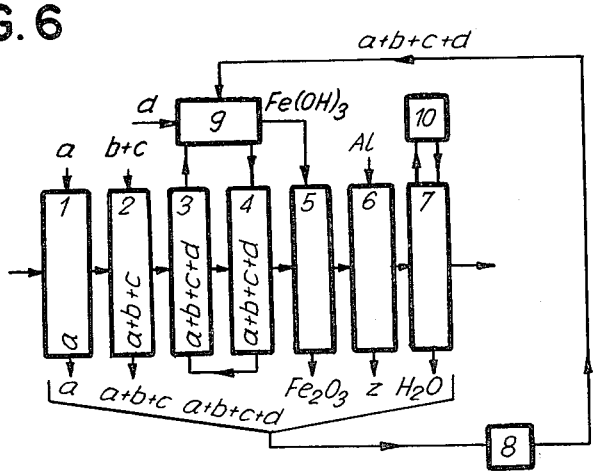

Small steel objects amounting to 10,000,000 kg anually, whereof the total area is 800,000 $m^2$, are coated with aluminium by means of a hot method. The steel objects are initially cleaned by sand-blasting, and then are aluminized by the method according to the invention. The steel objects are degreased 1, pickled in hydrochloric acid 2, wahsed in a flux 3, dipped in a pure flux 4, dried 5, dipped in liquid aluminium 6, cooled in water 7. Chemical compositions of particular baths and drippings is presented in the table, and the circulation of baths and drippings—in a technological diagram FIG. 6 wherein the wetting agent is ethoxylated alkylphenol whose trade name is rokafenol N-8—designated by the symbol a, the inhibitor b is hexamethylenetetramine, hydrochloric acid is designated by the symbol c, the flux being a mixture of ammonium chloride, sodium tetraborate and carboxymethylcellulose mixed at the mass ratio 20:10:1 is designated by the symbol d.

After initial sand-blasting the products do not contaminate strongly the degreasing and the pickling baths. Regeneration of these baths is not necessary because they are continuously renewed by making up the losses of the level of the liquid taken away on surfaces of products. Drippings 8 are added to the used flux. The flux bath is frequently regenerated in order to maintain low contamination with iron 9. Water from cooling is cooled in a cooler 10 and is used for making up the losses of water in baths.

| | | Content of a component in an aqueous solution % | | | | |
|---|---|---|---|---|---|---|
| item | Process | a | b | c | Fe | d |
| 1. | Degreasing | 1.1 | | | | |

-continued

| item | Process | Content of a component in an aqueous solution % | | | | |
|---|---|---|---|---|---|---|
| | | a | b | c | Fe | d |
| 2. | Pickling | 0.5 | 0.2 | 14.1 | 1.7 | |
| 3. | Washing | 0.5 | 0.2 | 0.9 | 0.1 | 28.3 |
| 4. | Fluxing | 0.5 | 0.2 | 0.1 | 0.01 | 29.1 |
| 5. | Drying | — | — | — | — | — |
| 6. | Hot aluminizing | — | — | — | — | — |
| 7. | Cooling | — | — | — | — | — |
| 8. | Drippings | 0.6 | 0.15 | 2.8 | 0.5 | 8.3 |

After aluminizing the coating is chemically dyed by a known method.

LIST OF DESIGNATIONS IN FIG. 6

1—degreasing
2—pickling
3—washing after pickling
4—fluxing
5—drying
6—hot aluminizing
7—cooling
8—drippings
9—regeneration of the flux
10—cooling of water
a—wetting agent
b—inhibitor
c—hydrochloric acid
d—flux
z—solid wastes.

EXAMPLE 7

Small steel object amounting to 50,000 kg anually, whereof the total area is 12,000 $m^2$, are nickel plated by a currentless method. The steel objects are degreased 1, degreased again 2, then washed 3, pickled in sulphuric acid 4, washed twice in a used bath after nickel plating 5 and 6, nickel plated by a currentless method 7, washed four times in water 8, 9, 10, 11, and dried 12.

Figure 7:
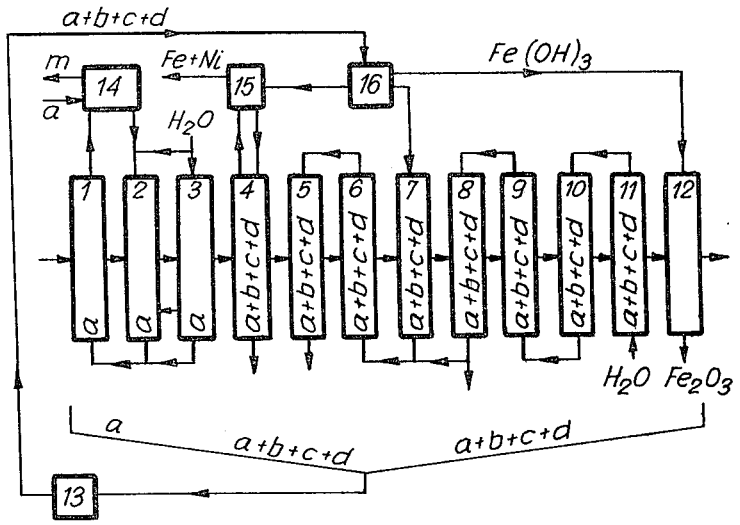

Chemical composition of particular baths and drippings is presented in the table, and the circulation of baths and drippings is presented in a technological diagram FIG. 7 wherein the degreasing bath constitutes a wetting agent a being a mixture of ethoxylated alkylphenol whose trade name is rokafenol N-8, sodium phosphate, hydroxide and silicate mixed at the mass ratio of 4:3:2:1, the inhibitor b is diethanolamine, sulphuric acid is designated by the symbol c, a bath for nickel plating which is a mixture of nickel sulfate, ammonium sulfate, boric acid and saccharin mixed at the mass ratio of 50:200:50:1 is designated by the symbol d. The used degreasing bath is regenerated 14. Used sulphuric acid is regenerated by means of an electrolysis 15. The used bath for nickel plating is purified from iron 16. The bath for nickel plating taken away on the nickel-plated surface returns to the process as a result of four cascade washings and thus in the cycle of the nickel bath the concentration of salts of nickel and ammonium sulfates increases. An excess of the bath for nickel plating is offtaken from the cycle of nickel plating and sulphuric acid is recovered by means of an electrolysis, which is then turned back to the pickling process. Drippings 13 from the whole process are added to the used nickel-plating bath.

| item | Process | Content of components in an aqueous solution in % | | | | | |
|---|---|---|---|---|---|---|---|
| | | a | b | c | d | Fe | Ni |
| 1. | Degreasing I | 3.8 | | | | | |
| 2. | Degreasing II | 2.5 | | | | | |
| 3. | Washing | 0.7 | | | | | |
| 4. | Pickling | 0.2 | 0.1 | 7.1 | 2.9 | 4.3 | 0.2 |
| 5. | Washing I | 0.2 | 0.1 | 1.7 | 18.1 | 0.7 | 1.1 |
| 6. | Washing II | 0.2 | 0.1 | 0.4 | 20.3 | 0.1 | 1.2 |
| 7. | Currentless nickel plating | 0.2 | 0.1 | 0.1 | 20.7 | 0.03 | 1.2 |
| 8. | Washing I | 0.1 | 0.05 | 0.05 | 10.3 | 0.05 | 0.6 |
| 9. | Washing II | 0.04 | 0.015 | 0.015 | 2.8 | 0.015 | 0.2 |
| 10. | Washing III | 0.01 | 0.005 | 0.005 | 0.8 | 0.005 | 0.1 |
| 11. | Washing IV | 0.002 | 0.001 | 0.001 | 0.2 | 0.001 | 0.0 |
| 12. | Drying | — | — | tc — | — | — | — |
| 13. | Drippings | 0.15 | 0.05 | 2.5 | 9.3 | 1.4 0.5 | |

The process of currentless coppering, chromium plating and zinc plating may proceed in a similar manner. If the main object of nickel plating is to apply a thin coating of nickel, the process is completed with several cascade washings in water, and if the nickel coating is to be an undercoat for other coatings, then instead of washing the next coatings may be applied, e.g. copper, nickel and chromium coatings.

LIST OF DESIGNATION IN FIG. 7

1—degreasing I
2—degreasing II
3—washing after degreasing
4—pickling
5—washing I after pickling
6—washing II after pickling
7—currentless nickel plating
8—washing I after nickel plating
9—washing II after nickel plating
10—washing III after nickel plating
11—washing IV after nickel plating
12—drying
13—drippings
14—regeneration of the degreasing bath
15—regeneration of sulphuric acid
16—regeneration of the bath for nickel plating
a—wetting agent
b—inhibitor
c—sulphuric acid
d—a bath for nickel plating
m—precipitate.

EXAMPLE 8

The previous examples presented metallization of a steel surface. However, the invention can be applied for metallization of any metals. The example for this may be the process of nickel plating of copper. If products or copper coatings are contaminated, then during nickel plating it is necessary to apply the traditional surface treatment consisting in degreasing and pickling.

Elements made of copper are degrease 1, washed 2, pickled in sulphuric acid 3, washed four times in a nickel-plating bath 4, 5, 6 and 7, nickel-plated 8, then washed four times in water 9, 10 and 11, and dried 12.

Figure 8:
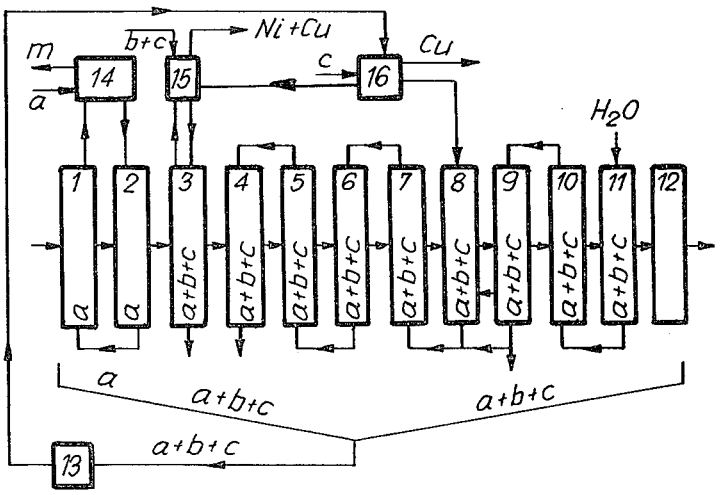

Chemical composition of particular baths and drippings is presented in the table, and the circulation of baths and drippings is presented in a technological drawing FIG. 8 wherein the wetting agent a means an equilibrium mixture of ethoxylated alkylphenol, whose trade name is rokafenol N-8, with sodium hydroxide and phosphate, sulphuric acid is designated by the symbol b, the bath for nickel plating being a mixture of nickel sulfate, ammonium sulfate and boric acid mixed at the mass ration of 5:1:1 is designated by the symbol c. The used degreasing bath is regenerated 14. Used sulphuric acid is regenerated by means of an electrolysis 15. The used bath for nickel plating is purified from copper by means of cementation with nickel dust. From an excess of the bath for nickel plating sulphuric acid is obtained by means of an electrolysis, which is then turned back to the process of pickling. The drippings 13 from the whole process are added to the used nickel-plating bath.

| item | Process | Content of a component in an aqueous solution % | | | | |
|---|---|---|---|---|---|---|
| | | a | b | c | Cu | Ni |
| 1. | Degreasing | 1.1 | | | | |
| 2. | Washing | 0.9 | | | | |
| 3. | Pickling | 0.4 | 9.2 | 1.1 | 3.5 | 0.3 |
| 4. | Washing I | 0.4 | 3.1 | 24.1 | 1.2 | 6.5 |
| 5. | Washing II | 0.4 | 1.3 | 26.3 | 0.4 | 7.1 |
| 6. | Washing III | 0.4 | 0.4 | 27.3 | 0.15 | 7.3 |
| 7. | Washing IV | 0.4 | 0.1 | 27.6 | 0.04 | 7.4 |
| 8. | Nickel plating | 0.4 | 0.03 | 27.8 | 0.01 | 7.5 |
| 9. | Washing I | 0.1 | 0.01 | 9.1 | 0.002 | 2.4 |
| 10. | Washing II | 0.04 | 0.004 | 2.3 | 0.001 | 0.6 |
| 11. | Washing III | 0.01 | 0.001 | 0.5 | 0.0003 | 0.15 |
| 12. | Drying | — | — | — | — | — |
| 13. | Drippings | 0.3 | 2.5 | 11.3 | 0.9 | 2.9 |

LIST OF DESIGNATIONS IN FIG. 8

1—degreasing I
2—degreasing II
3—pickling
4—washing I after pickling
5—washing II after pickling
6—washing III after pickling
7—washing IV after pickling
8—nickle electroplating
9—washing I after nickel plating
10—washing II after nickel plating
11—washing III after nickel plating
12—drying
13—drippings
14—regeneration of the degreasing bath
15—regeneration of sulphuric acid
16—regeneration of the bath for nickel plating
a—wetting agent
b—sulphuric acid
c—bath for nickel plating
m—precipitate.

The invention can be applied especially in galvanizing of a steel surface, however, it can be also applied for coating of some other metals, especially aluminium, tin, cadmium, lead, nickel, copper, chromium, manganese, cobalt, iron. In the process of metallization it is possible to employ the known degreasing and pickling baths, the known fluxes and electrolytes selected and put together according to the requirements in the invention, or new baths may be selected whose compositions facilitate the application of the invention. For regeneration of the used baths the known methods of regeneration may be used, or new methods of regeneration may be worked out which facilitate the application of the invention.

The invention may be employed for applying of metal coatings by means of any known method, especially by the hot, galvanic, currentless, diffusion, metal spraying method, upon the surface of another metal.

What is claimed is:

1. A method for coating a metal substrate with another metal, including particularly the zinc-coating of steel surfaces, to substantially eliminate the production of sewage and/or harmful waste products, comprising contacting the substrate successively with a series of baths to perform the steps of degreasing, etching, activation, and metal coating, the components of each bath containing not only those components necessary to perform the function of that bath but also components from the preceding bath, recycling the waste products from each bath to a preceding bath containing the same components as said waste products, regenerating the baths as depleted, and washing the resulting product with water only after coating thereof has been completed.

* * * * *